US011039672B2

(12) United States Patent
Neill

(10) Patent No.: US 11,039,672 B2
(45) Date of Patent: Jun. 22, 2021

(54) PORTABLE CARRIER FOR STORING ONE OR MORE OBJECTS AND METHODS THEREOF

(71) Applicant: Rodney Neill, Turner Falls, MA (US)

(72) Inventor: Rodney Neill, Turner Falls, MA (US)

( * ) Notice: Subject to any disclaimer, the term of this patent is extended or adjusted under 35 U.S.C. 154(b) by 254 days.

(21) Appl. No.: 15/971,303

(22) Filed: May 4, 2018

(65) Prior Publication Data

US 2018/0249800 A1 Sep. 6, 2018

Related U.S. Application Data

(63) Continuation-in-part of application No. 15/477,162, filed on Apr. 3, 2017, now Pat. No. 10,852,115.

(60) Provisional application No. 62/495,599, filed on May 5, 2017, provisional application No. 62/316,829, filed on Apr. 1, 2016, provisional application No. 62/401,563, filed on Sep. 29, 2016, provisional application No. 62/442,193, filed on Jan. 4, 2017.

(51) Int. Cl.

| | |
|---|---|
| ***A45C 13/02*** | (2006.01) |
| ***F42B 39/26*** | (2006.01) |
| ***A45F 5/10*** | (2006.01) |
| ***A45C 13/10*** | (2006.01) |

(52) U.S. Cl.

CPC ..... *A45C 13/02* (2013.01); *A45C 13/1069* (2013.01); *A45F 5/10* (2013.01); *F42B 39/26* (2013.01); *A45F 2200/0575* (2013.01); *A45F 2200/0591* (2013.01)

(58) Field of Classification Search

CPC ..... A45F 5/10; A45F 2200/0575; A45F 2200/0591; A45C 13/02; A45C 13/1069; F42B 39/26

USPC ..... 53/413

See application file for complete search history.

(56) References Cited

U.S. PATENT DOCUMENTS

| | | | | | |
|---|---|---|---|---|---|
| 4,047,650 | A | * | 9/1977 | Domingos | A45F 5/02 224/223 |
| 4,825,526 | A | * | 5/1989 | Shenier | A41F 1/002 24/303 |
| 5,249,338 | A | * | 10/1993 | Aoki | A41F 1/002 24/303 |
| D352,604 | S | * | 11/1994 | Johnson | D3/301 |
| 5,671,951 | A | * | 9/1997 | Palmiter | B42D 3/12 206/214 |
| 5,707,091 | A | * | 1/1998 | Morita | E05C 19/16 24/303 |

(Continued)

*Primary Examiner* — Dariush Seif

(74) *Attorney, Agent, or Firm* — Grogan, Tuccillo & Vanderleeden, LLP

(57) ABSTRACT

A portable carrier for storing one or more objects includes a first portion, a second portion, and a third portion. The first portion has a first side and a second side opposite the first side. The second portion has a third side and a fourth side opposite the third side. The third portion connects the first portion to the second portion and is adapted to allow the first portion and the second portion to transition between an open position and a closed position. The first side and the second side are transversely aligned with the third side and the fourth side, respectively, when the first portion and the second portion are in the open position, and the second side faces the fourth side with the first side opposite the third side when the first portion and the second portion are in the closed position.

8 Claims, 9 Drawing Sheets

(56) References Cited

U.S. PATENT DOCUMENTS 6,170,131 B1 * 1/2001 Shin ..... A41F 1/002 24/303
6,796,344 B2 * 9/2004 Chen ..... A45C 1/024 150/113
8,573,458 B1 * 11/2013 Hamilton ..... A45F 5/021 224/250
9,549,606 B1 * 1/2017 Casadesus ..... F41H 1/00
10,226,109 B1 * 3/2019 Calder ..... A45C 13/02
2004/0084494 A1 * 5/2004 Gilliam ..... F41C 33/02 224/583
2008/0031680 A1 * 2/2008 Buddharaju ..... A45C 15/06 402/35
2008/0035523 A1 * 2/2008 Lemire ..... A45C 13/26 206/774
2008/0121730 A1 * 5/2008 Calkin ..... A45F 3/06 238/12
2010/0193559 A1 * 8/2010 Van Huyssteen ..... A63B 57/60 224/680
2011/0317943 A1 * 12/2011 Russo ..... A45C 7/00 383/95
2012/0248793 A1 * 10/2012 Fiedler ..... A44B 11/2592 292/163
2014/0061084 A1 * 3/2014 Westrup ..... A45C 11/00 206/472
2015/0108739 A1 * 4/2015 Kassab Arabo ..... A45C 7/0063 280/651
2015/0168099 A1 * 6/2015 Hyde ..... F41C 33/06 206/317
2015/0305463 A1 * 10/2015 Huyke-Phillips ..... B29C 44/12 150/127
2016/0003269 A1 * 1/2016 Russell-Clarke ..... A44B 17/0041 24/303
2016/0018849 A1 * 1/2016 Tilney ..... A45F 5/00 224/267
2016/0198819 A1 * 7/2016 Grund ..... A45C 15/04 132/288
2016/0353849 A1 * 12/2016 Macadaan ..... A45C 11/24
2017/0042349 A1 * 2/2017 Batros ..... A47G 9/1027
2017/0049201 A1 * 2/2017 Moreau ..... A45F 5/021
2017/0119131 A1 * 5/2017 Barber ..... A45F 3/04
2017/0188674 A1 * 7/2017 Dotey ..... B60R 7/043

* cited by examiner

PORTABLE CARRIER FOR STORING ONE OR MORE OBJECTS AND METHODS THEREOF

CROSS-REFERENCE TO RELATED APPLICATIONS

This application is a continuation in part of U.S. patent application Ser. No. 15/477,162, filed on Apr. 3, 2017, which claims priority to and the benefit of U.S. Provisional Pat. App. Ser. Nos. 62/316,829, 62/401,563, and 62/442,193, filed on Apr. 1, 2016, Sep. 29, 2016, and Jan. 4, 2017, respectively. This application additionally claims priority to and the benefit of U.S. Provisional Pat. App. Ser. No. 62/495,599, filed May 5, 2017. The disclosures of all of the aforementioned applications being incorporated herein by reference in their entirety.

BACKGROUND

Technical Field

Embodiments of the invention relate to storage systems, and more specifically, to a portable carrier for storing one or more objects and methods thereof.

Discussion of Art

There is currently a need for a portable carrier that can hold magazines containing ammunition, tools, documents, and/or other objects, that can be securely but removably mounted to metal surfaces, such as walls or other surfaces in nuclear power plants, correctional facilities and military installations. There is also a need for portable carriers such as the above that can hold tools and other items for use by automotive workers, construction workers and the like. Embodiments of the invention fulfill these needs, among many others.

BRIEF DESCRIPTION

In an embodiment, a portable carrier for storing one or more objects is provided. The portable carrier includes a first portion, a second portion, and a third portion. The first portion has a first side and a second side opposite the first side. The second portion has a third side and a fourth side opposite the third side. The third portion connects the first portion to the second portion and is adapted to allow the first portion and the second portion to transition between an open position and a closed position. At least one of the first side and the third side include one or more object fasteners for fastening the one or more objects to the first portion and the second portion, respectively. The first side and the second side are transversely aligned with the third side and the fourth side, respectively, when the first portion and the second portion are in the open position, and the second side faces the fourth side with the first side opposite the third side when the first portion and the second portion are in the closed position.

In another embodiment, a method of storing one or more objects is provided. The method includes fastening the one or more objects to a portable carrier. The portable carrier includes a first portion, a second portion, and a third portion. The first portion has a first side and a second side opposite the first side. The second portion has a third side and a fourth side opposite the third side. The third portion connects the first portion to the second portion. The method further includes transitioning the first portion and the second portion from a closed position to an open position. The second side faces the fourth side with the first side opposite the third side when the first portion and the second portion are in the closed position. The first side and the second side are transversely aligned with the third side and the fourth side, respectively, when the first portion and the second portion are in the open position. The method further includes transitioning the first portion and the second portion from the closed position to the open position.

In yet another embodiment, a fastener for a portable carrier is provided. The fastener includes a steel channel, a magnet, and a fabric strip. The steel channel has a base portion and two legs with two fold-overs. The magnet is disposed within the steel channel and secured in part by the two fold-overs. The fabric strip passes between the two legs, over the magnet, and under the two fold-overs.

In still yet another embodiment, another fastener for a portable carrier is provided. The fastener includes a steel channel and a magnet. The steel channel has a base portion and two legs. The base portion has two slots operative to secure the fastener to a portable carrier via a fabric strip. The magnet is disposed within the steel channel.

DRAWINGS

The present invention will be better understood from reading the following description of non-limiting embodiments, with reference to the attached drawings, wherein below:

DETAILED DESCRIPTION

Figure 1:
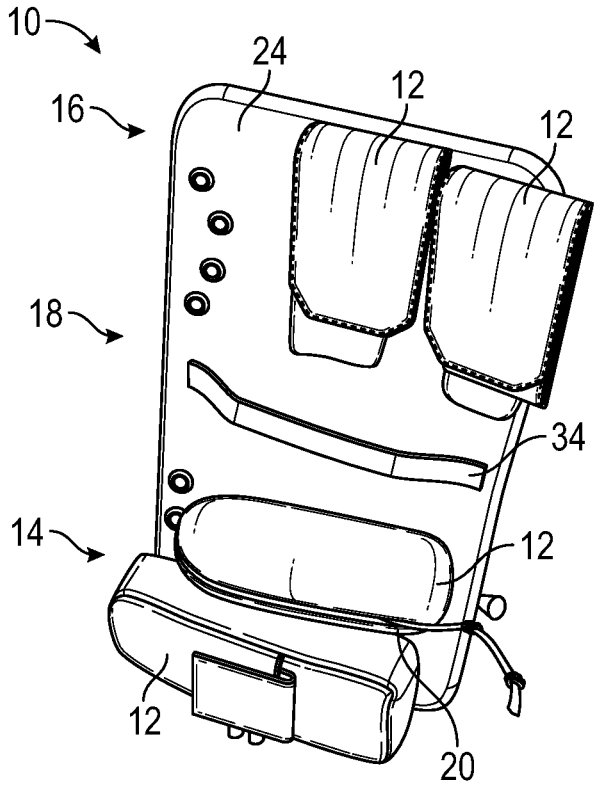
FIG. 1 is a diagram of a portable carrier for storing one or more objects, in accordance with an embodiment of the present invention.
Figure 2:
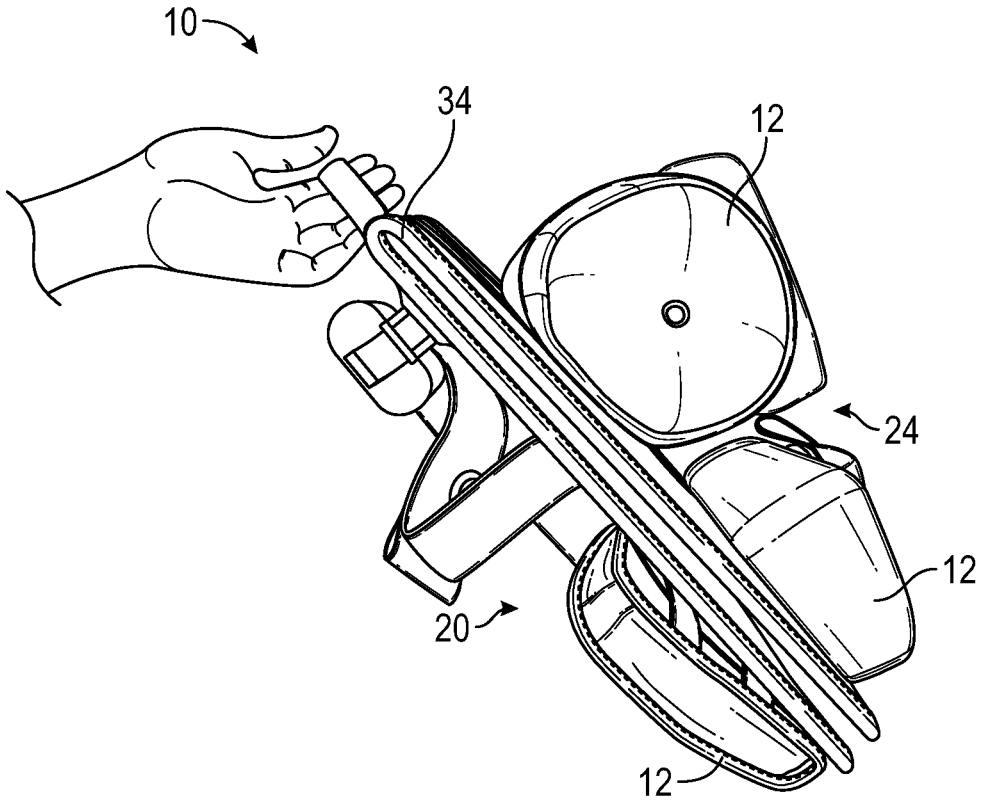
FIG. 2 is another diagram of the portable carrier for storing one or more objects, in accordance with an embodiment of the present invention.
Figure 3:
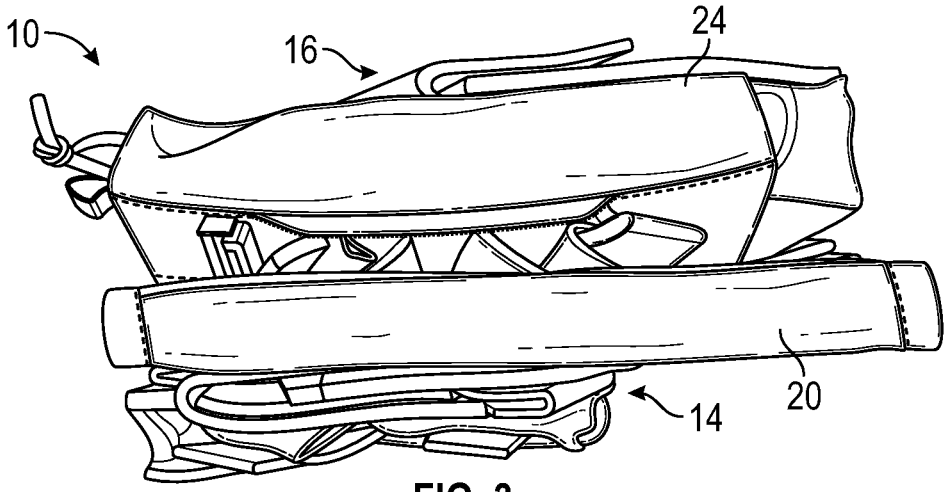
FIG. 3 is another diagram of the portable carrier for storing one or more objects, in accordance with an embodiment of the present invention.
Figure 4:
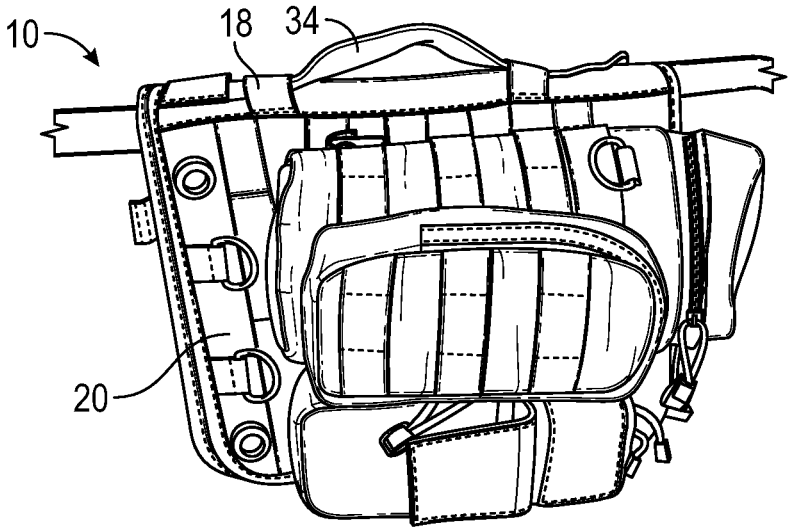
FIG. 4 is another diagram of the portable carrier for storing one or more objects, in accordance with an embodiment of the present invention.
Figure 5:
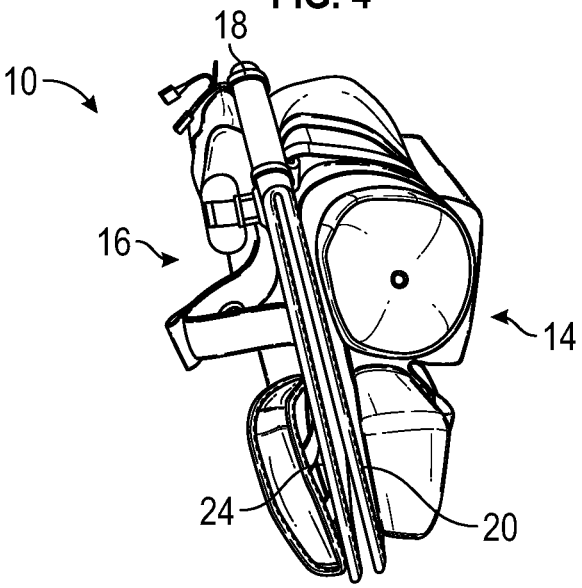
FIG. 5 is another diagram of the portable carrier for storing one or more objects, in accordance with an embodiment of the present invention.

Reference will be made below in detail to exemplary embodiments of the invention, examples of which are illustrated in the accompanying drawings. Wherever possible, the same reference characters used throughout the drawings refer to the same or like parts.

Referring now to FIGS. 1-7, a portable carrier/system 10 for storing one or more objects 12, in accordance with an embodiment of the present invention, is shown. The carrier 10 includes a first portion 14, a second portion 16, and a third portion 18. The first portion 14 has a first side 20 (best seen in FIG. 6) and a second side 22 (best seen in FIG. 7) opposite the first side 20. The second portion 16 has a third side 24 (best seen in FIG. 6) and a fourth side 26 (best seen in FIG. 7) opposite the third side 24. The third portion 18 connects the first portion 14 to the second portion 16 and is adapted to allow the first portion 14 and the second portion 16 to transition between a first/open/deployed position (shown in FIGS. 1 and 6-7) and a second/closed/carry position (shown in FIGS. 2-5). At least one of the first side 20 and the third side 24 include one or more object fasteners 28 (best seen in FIG. 6) for fastening the one or more objects 12 to the first portion 14 and the second portion 16, respectively. The first side 20 and the second side 22 are transversely aligned with the third side 24 and the fourth side 26, respectively, when the first portion 14 and the second portion 16 are in the open position, and the second side 22 faces the fourth side 26 with the first side 20 opposite the third side 24 when the first portion 14 and the second portion 16 are in the closed position. The term "transversely aligned," as used herein with respect to the first 14, second 16, and third 18 portions, means that the first portion 14, second portion 16, and third 18 portion are, or substantially, aligned along the same longitudinal axis so as to form a continuous and/or nearly continuous surface. In other words, the first 14, second 16, and third 18 portions are laid-out in a nearly flat configuration, or a configuration that follows the contour of the wall/surface to which the carrier 10 may be attached/secured to. As will be appreciated, in embodiments, the carrier 10 may be mountable to a curved surface/wall such as a tank and round structural beam.

The first 14 and/or second 16 portions may be made of fabric, plastic, rubber, wood, composites, and/or any other suitable material. As will be understood, the first 14 and second 16 portions may be stiffer, i.e., less flexible, than the third 18 portion. For example, in embodiments, the first 14 and second 16 portions may be formed by covering backings, e.g., aluminum plates and/or other suitable materials such as plastic, wood, and/or composite, with fabric, and the third portion 18 may be a section of fabric having no internal backing. In embodiments, the first 14, second 16, and third 18 portions may form two surfaces having areas of about 8-15" by about 8-15" in the closed position, and a single surface having an area of about 8-15" by about 16-30" in the open position.

The object fasteners 28 may be formed from weaved loops made out of fabric strips, metal loops, clips, hook-and-loop fasteners, buttons, zippers, and/or any other appropriate type of fastener for fastening/securing objects 12, e.g., ammo magazines, work tools, liquid containers, etc. The first 14 and/or second 16 portions may further include one or more grommets 30 (FIG. 6) and/or rings 32 (FIG. 6), which may be used to secure additional items to the carrier 10, and/or to secure the carrier 10 to another (larger) object.

Figure 6:
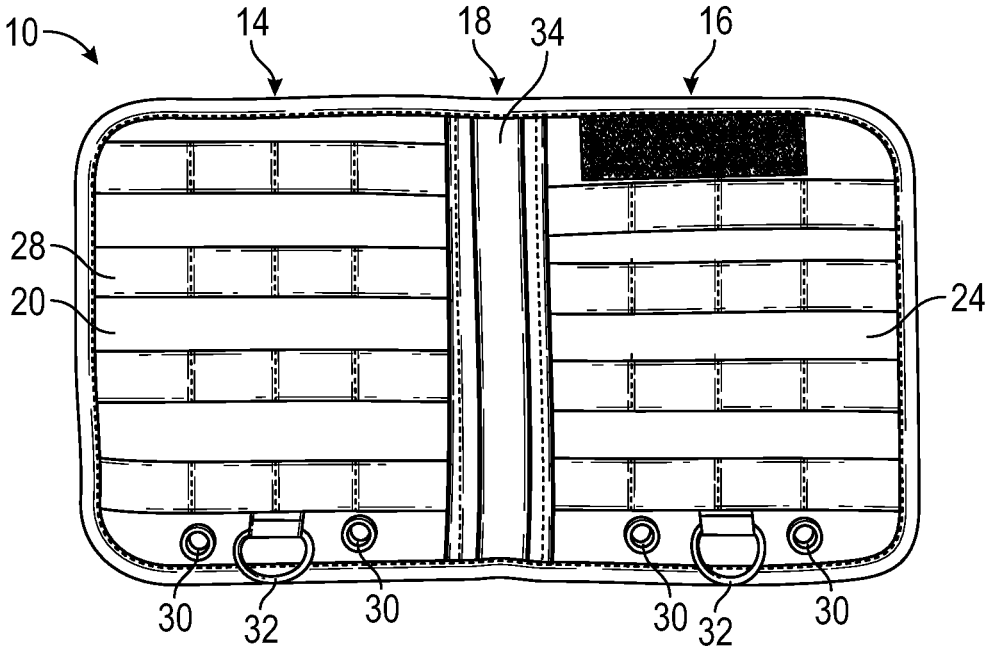
FIG. 6 is another diagram of the portable carrier for storing one or more objects, in accordance with an embodiment of the present invention.
Figure 8:
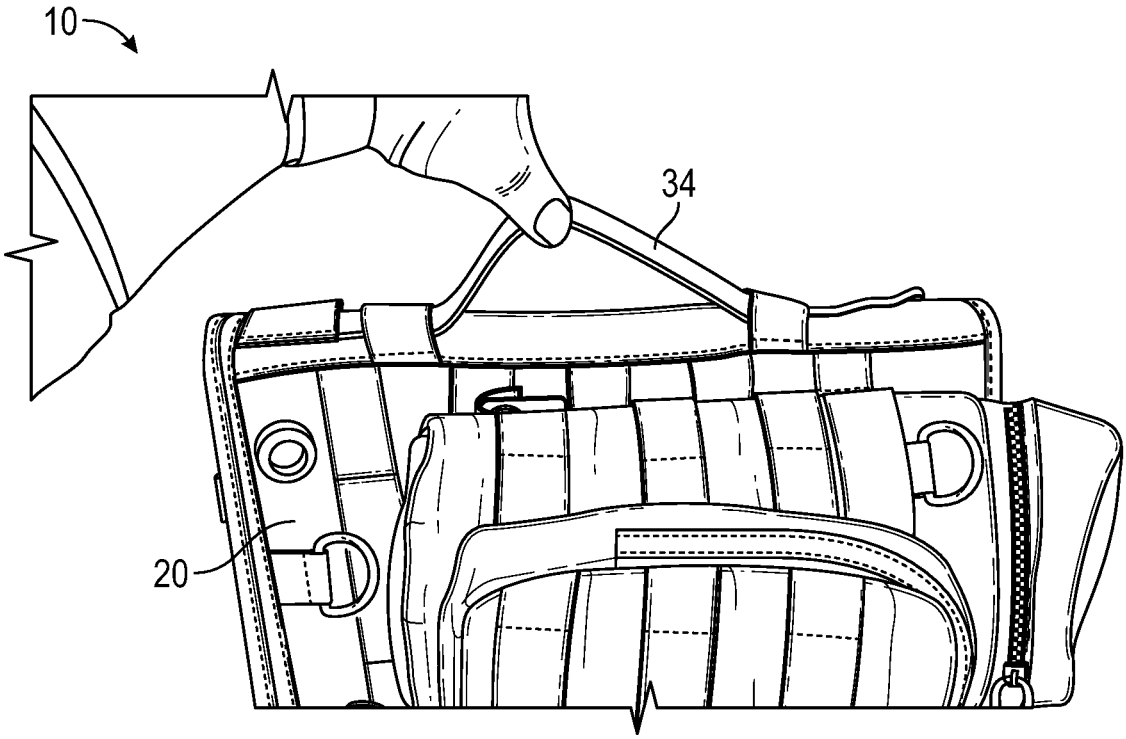
FIG. 8 is another diagram of the portable carrier for storing one or more objects, in accordance with an embodiment of the present invention.
Figure 9:
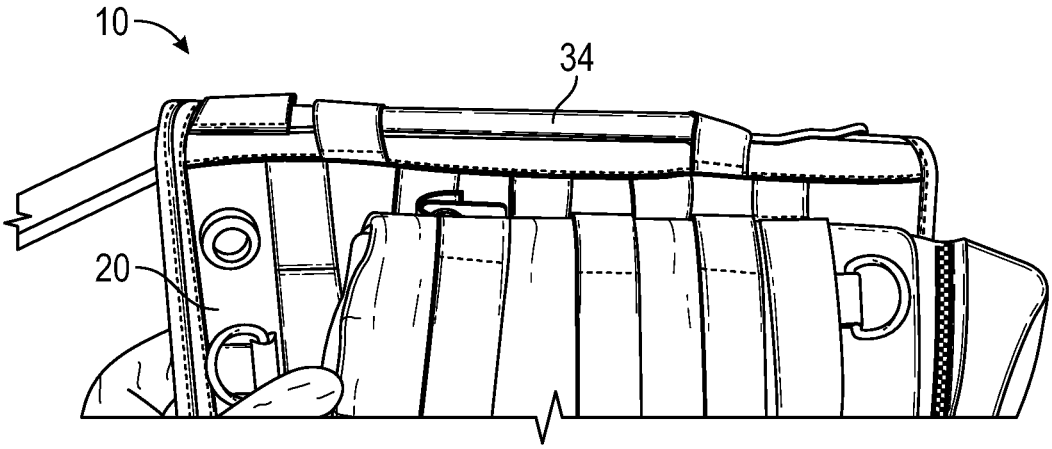
FIG. 9 is another diagram of the portable carrier for storing one or more objects, in accordance with an embodiment of the present invention.

Referring now to FIGS. 6 and 8-9, in embodiments, the carrier 10 may further include a handle 34, which, as will be discussed in greater detail below, may facilitate the transition of the portions 14, 16 from the open position to the closed position. The handle 34 may be made of an elastic material such that handle 34 will extend outward from the third 18 portion when pulled on (best seen in FIG. 8), and subsequently retract when released so that the handle 34 lies flat against the third portion 18 (best seen in FIG. 9). As will be appreciated, the auto-retraction of the handle 34 prevents the handle 34 from unintendedly snaring/snagging on items/objects, e.g., door handles, pipe openings, tree branches, etc. Further, while the handle 34 is shown in the provided figures as being centrally disposed on the third portion 18, it will be understood that the handle 34 may be disposed on the first 14 and/or second 16 portions and/or any combination thereof.

Figure 7:
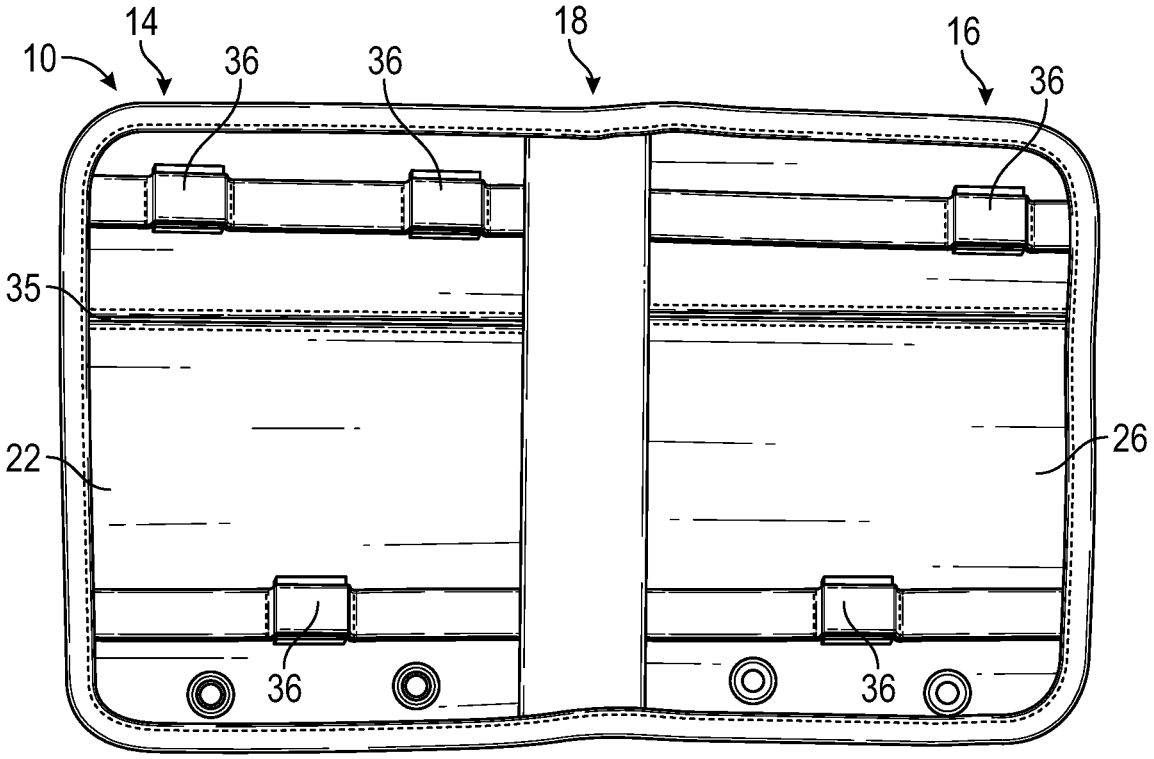
FIG. 7 is another diagram of the portable carrier for storing one or more objects, in accordance with an embodiment of the present invention.
Figure 10:
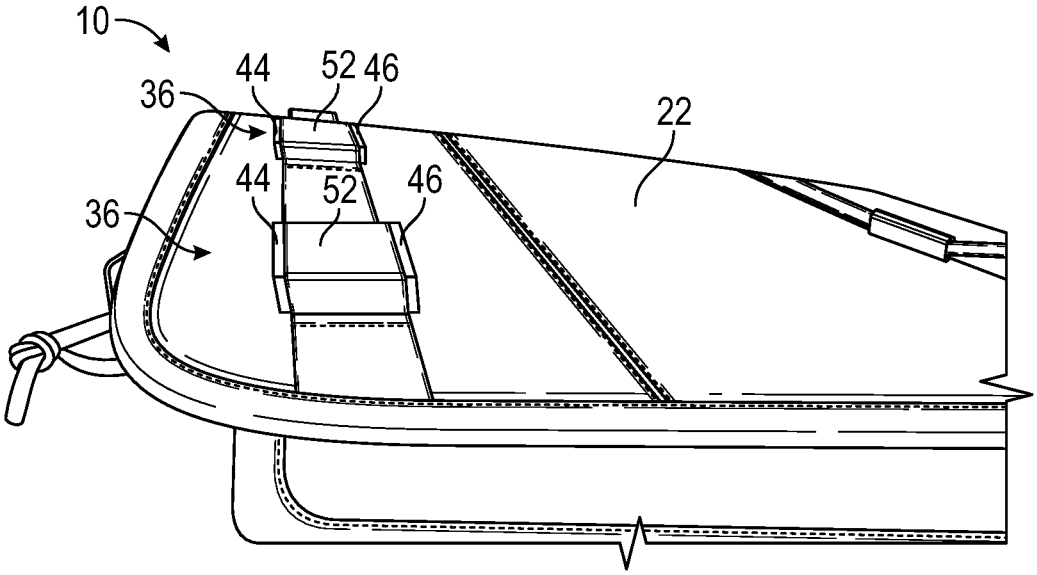
FIG. 10 is another diagram of the portable carrier for storing one or more objects, in accordance with an embodiment of the present invention.
Figure 11:
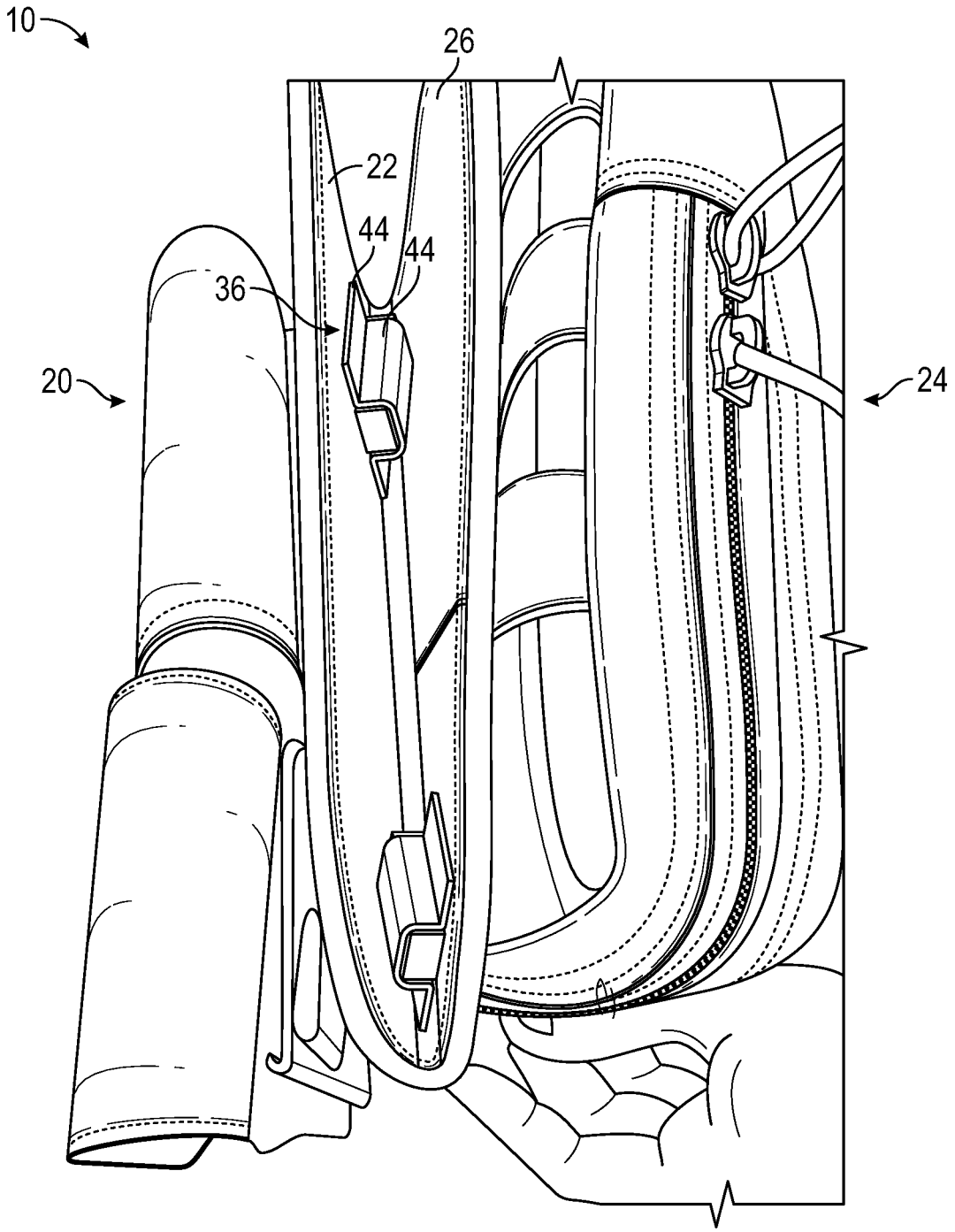
FIG. 11 is another diagram of the portable carrier for storing one or more objects, in accordance with an embodiment of the present invention.

Turning now to FIGS. 7 and 10-11, in embodiments, the first 20, second 22, third 24, and/or fourth 26 sides may include one or more slots 35 (FIG. 7) for storing documents and/or other thin objects 12, e.g., plastic cards, rulers, etc. Additionally, at least one of the second side 22 and the fourth side 26 include one or more portion fasteners 36 adapted to fasten the fourth side 26 to the second side 22 when the first portion 14 and the second portion 16 are in the closed position (best seen in FIG. 11). The fasteners 36 may be further adapted to fasten the carrier 10 to a metal surface, e.g., the innards of a manufacturing machine, the wall of a vehicle, and/or any other magnetic surface such as a filing cabinet (best seen in FIG. 1).

As can be seen in FIG. 7, the fasteners 36 may be disposed on the second 22 and fourth 26 sides such that some of the fasteners 36 are disposed near the edges of the second 22 and fourth 26 sides that are the furthest away from the third portion 18, and such that some of the fasteners 36 are disposed on the second 22 and fourth 26 sides near the third portion 18. As will be appreciated, disposing the fasteners 36 in such an arrangement mitigates the likelihood that the second 22 and fourth 26 sides will buckle and/or otherwise separate from a metal wall to which the carrier 10 is attached to while the first 14 and second 16 portions are in the open position. In embodiments, the fasteners 36 may be disposed in a staggered arrangement as shown in FIG. 7, which as will be appreciated, reduces the number of fasteners 36 required to sufficiently keep the carrier 10 attached to a metal wall when the first 14 and second 16 portions are in the open position.

Figure 13:
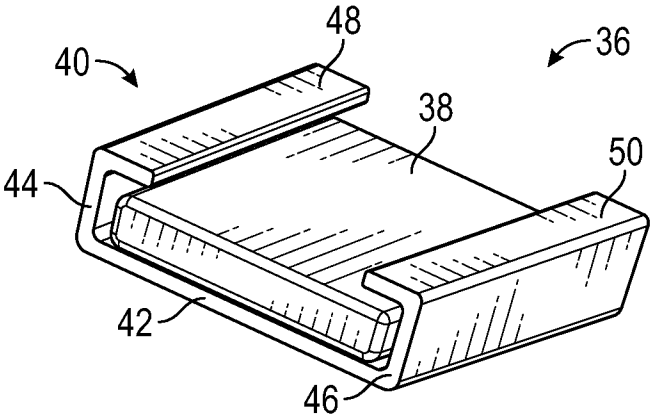
FIG. 13 is another diagram of a portion fastener of the portable carrier of FIG. 1, in accordance with an embodiment of the present invention.
Figure 12:
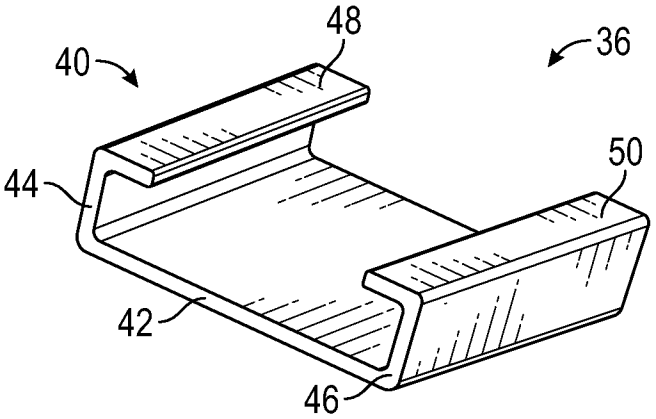
FIG. 12 is a diagram of a portion fastener of the portable carrier of FIG. 1, in accordance with an embodiment of the present invention.
Figure 14:
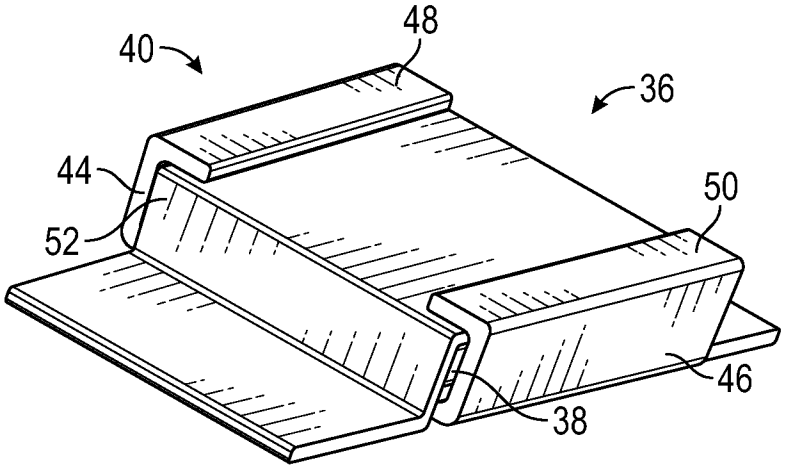
FIG. 14 is another diagram of a portion fastener of the portable carrier of FIG. 1, in accordance with an embodiment of the present invention.

As further shown in FIGS. 7 and 10-11, in embodiments, the portion fasteners 36 may be magnets sewn into the second 22 and/or fourth 26 sides. For example, as illustrated in FIGS. 12-14, each fastener 36 may be a magnet 38 disposed/contained/secured within a steel channel 40 having a base portion 42 and two legs 44 and 46 with two fold-overs 48 and 50. The magnet 38 may be disposed on the base 42 and held in place, i.e., secured at least in part, by the legs 44, 46 and/or fold-overs 48, 50. A fabric strip 52 may then be passed between the legs 44, 46, over the magnet 38, and under the two folder-overs 48, 50. As will be understood, the magnetic force generated by the magnet 38 may be carried/directed by the legs 44, 46 and/or the two fold-overs 48, 50. Accordingly, as will be appreciated, the strength of the magnetic coupling between the legs 44, 46 (and/or fold-overs 48, 50) with a metal object, e.g., a metal wall, in embodiments in which the legs 44, 46 and/or the two fold-overs 48, 50 extend above the fabric strip 52, is larger than the magnetic coupling strength would be if the fabric strip 52 were disposed over the legs 44, 46 and fold-overs 48, 50. In embodiments, the steel channel 40 may have legs 44, 46 and no fold-overs 48, 50.

As will be appreciated, in embodiments, the magnet 38 may have a width, i.e., the distance between the legs 44, 46, of about 0.62", a length of about 1", and a height, i.e., in the direction normal to the surface of the base portion 42, of about 0.16". Accordingly, in embodiments, the base 42 may have a width, i.e., the distance between the legs 44, 46, of about 0.89", a length, i.e., the distance along the legs 44, 46, of about 1", and a thickness of about 0.04". In such embodiments, each leg 44, 46 may be about 0.25" to about 0.275" in length/height and have a thickness of about 0.4". For example, in embodiments, each leg 44, 46 may have a height, i.e., in the direction normal to the surface of the base portion 42, of about 0.253".

As will also be appreciated, while the fasteners 36 and wall are disclosed herein as being magnets and metal, respectively, it will be understood that the fasteners 36 and wall may be made from other materials. For example, the fasteners 36 may include adhesives and/or loop-and-hook fasteners, and the wall may be wood, composite, fabric, and/or any other suitable material to which the fasteners 36 can be securely attached to.

Figure 17:
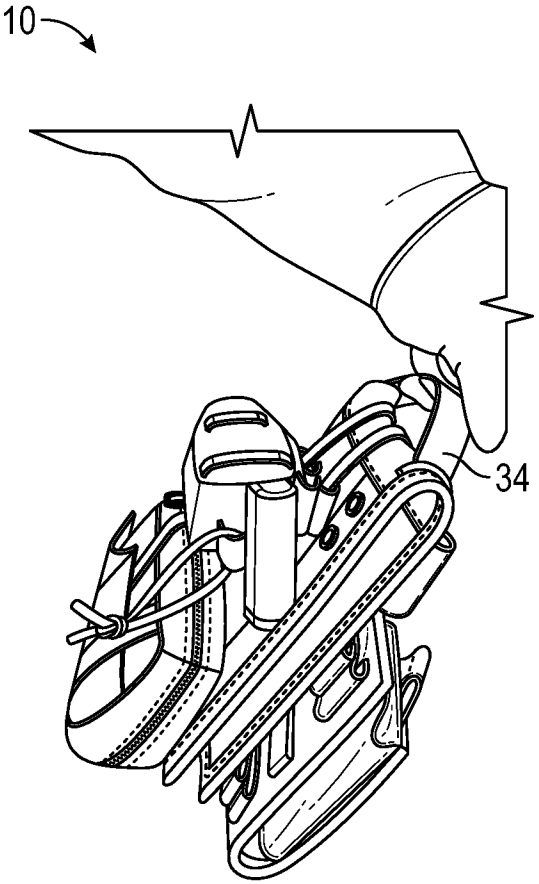
FIG. 17 is another diagram of the portable carrier for storing one or more objects, in accordance with an embodiment of the present invention.
Figure 16:
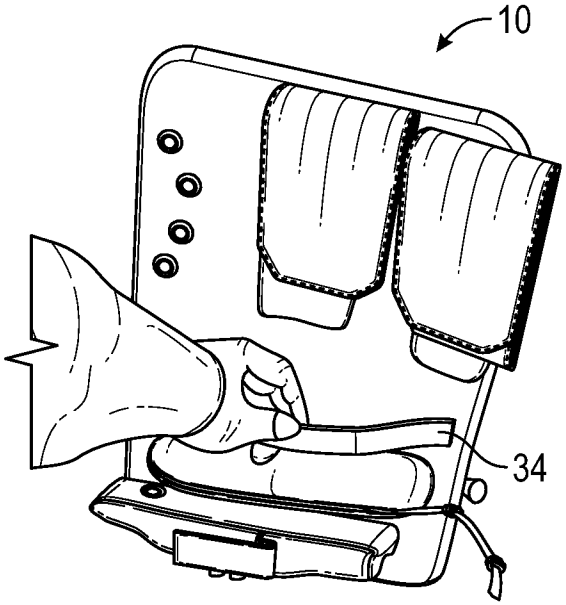
FIG. 16 is another diagram of the portable carrier for storing one or more objects, in accordance with an embodiment of the present invention.
Figure 15:
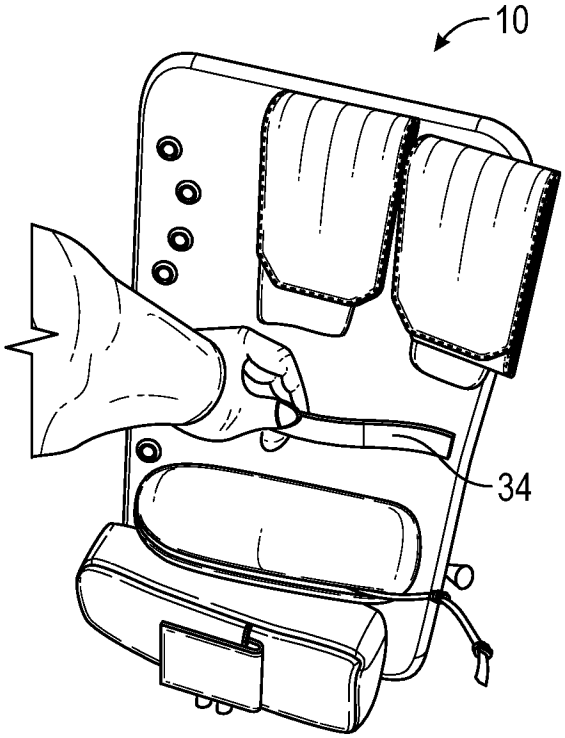
FIG. 15 is another diagram of the portable carrier for storing one or more objects, in accordance with an embodiment of the present invention.

Moving now to FIGS. 1 and 15-17, in operation, according to an embodiment, one or more objects 12 are fastened to the carrier 10 via the object fasteners 28 (FIG. 6), the first 14 and second 16 portions are transitioned to the open position, and the carrier 10 is fastened to a metal wall via the portion fasteners 36 as best seen in FIG. 1. The carrier 10 may then be removed from the metal wall by transitioning the first 14 and second 16 portions to the closed position. For example, in embodiments, a user may transition the first 14 and second 16 portions to the closed position by grabbing the handle 34 as shown in FIG. 15, and pulling the handle 34 as shown in FIG. 16 until the carrier 10 detaches from the wall and the first 14 and second 16 portions move into the closed position as shown in FIG. 17. As will be appreciated, the transition of the first 14 and second 16 portions to the second position from the first position may also be facilitated at least in part by gravity and/or a spring.

Figure 19:
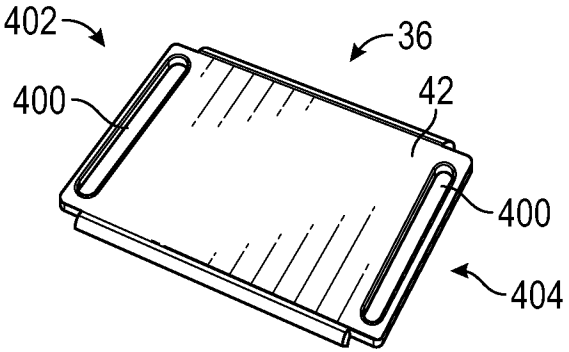
FIG. 19 is another diagram of the portion fastener of FIG. 18, in accordance with an embodiment of the present invention.
Figure 21:
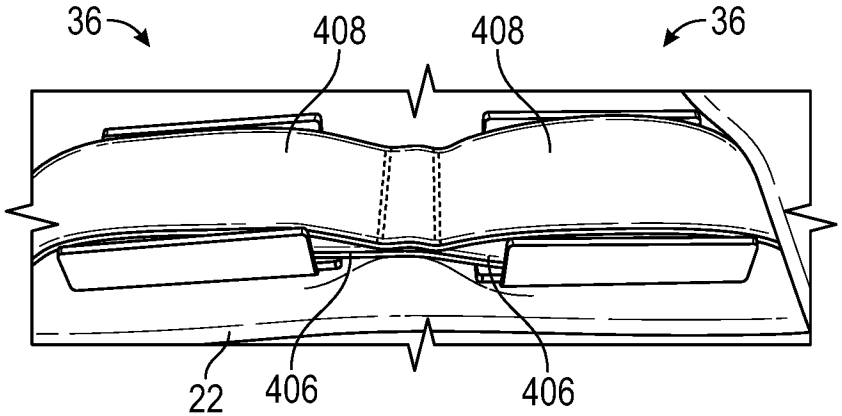
FIG. 21 is diagram of two portion fasteners, in accordance with the embodiment shown in FIGS. 18-20, wherein the portion fasteners are secured to the portable carrier of FIG. 1, in accordance with an embodiment of the present invention.
Figure 18:
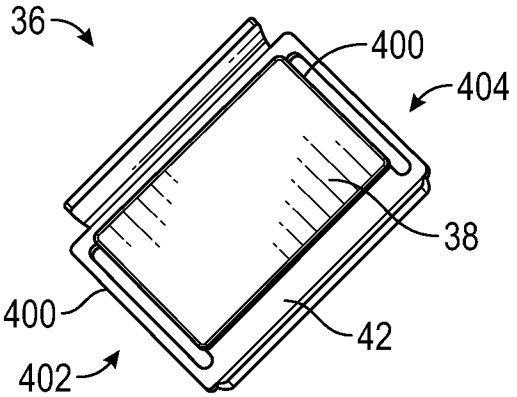
FIG. 18 is a diagram of another embodiment of the portion fastener of FIG. 12, wherein the portion fastener has slots, in accordance with an embodiment of the present invention.
Figure 20:
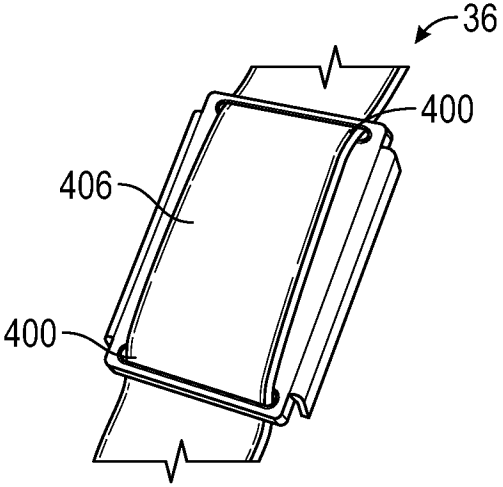
FIG. 20 is yet another diagram of the portion fastener of FIG. 18, in accordance with an embodiment of the present invention.

Illustrated in FIGS. 18 and 19 is another embodiment of the portion fastener 36 wherein the portion fastener 36 has slots 400, and (optionally) may not have fold over portions. In embodiments, the slots 400 may be disposed at the ends 402 and 404 of the base portion 42. As shown in FIG. 20, a fabric strip/strap 406 may be strung through the slots 400 so as to secure the base portion 42 in place on the second 22 and/or fourth 26 side of the carrier 10. As shown in FIG. 21, once the base portion 42 has been secured to the second 22 and/or fourth 26 side via strip/strap 406, a second fabric strip/strap 408 may then be strung over the magnet 38 so as to secure the magnet 38 in pace within the base portion 42. In embodiments, strip 406 may pass under the base portion 42, i.e., the base portion 42 is disposed between the side 22 and/or 26 and the magnet 38, and strip 408 may pass over the magnet 38, i.e., the magnet 38 is between the strip 408 and the base portion 42. In embodiments, strips 406 and/or 408 may be further secured to the second 22 and the fourth 26 sides.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment, a portable carrier for storing one or more objects is provided. The portable carrier includes a first portion, a second portion, and a third portion. The first portion has a first side and a second side opposite the first side. The second portion has a third side and a fourth side opposite the third side. The third portion connects the first portion to the second portion and is adapted to allow the first portion and the second portion to transition between an open position and a closed position. At least one of the first side and the third side include one or more object fasteners for fastening the one or more objects to the first portion and the second portion, respectively. The first side and the second side are transversely aligned with the third side and the fourth side, respectively, when the first portion and the second portion are in the open position, and the second side faces the fourth side with the first side opposite the third side when the first portion and the second portion are in the closed position. In certain embodiments, at least one of the second side and the fourth side include one or more portion fasteners adapted to fasten the fourth side to the second side when the first portion and the second portion are in the closed position. In certain embodiments, the portion fasteners are disposed in a staggered arrangement. In certain embodiments, the portion fasteners are magnets. In certain embodiments, each magnet is contained within a steel channel having a base portion and two legs with two fold-overs, each magnet secured in part by the two fold-overs. In certain embodiments, a fabric strip passes between the two legs over the magnet and under the two fold-overs. In certain embodiments, the two fold-overs direct a magnetic force generated by the magnet. In certain embodiments, at least one of the first portion and the second portion include a grommet. In certain embodiments, each magnet is contained within a steel channel having a base portion with one or more slots. A fabric strip passes through the slots so as to secure the base portion to at least one of the second and the fourth sides of the portable carrier.

Other embodiments provide for a method of storing one or more objects. The method includes fastening the one or more objects to a portable carrier. The portable carrier includes a first portion, a second portion, and a third portion. The first portion has a first side and a second side opposite the first side. The second portion has a third side and a fourth side opposite the third side. The third portion connects the first portion to the second portion. The method further includes transitioning the first portion and the second portion from a closed position to an open position. The second side faces the fourth side with the first side opposite the third side when the first portion and the second portion are in the closed position. The first side and the second side are transversely aligned with the third side and the fourth side, respectively, when the first portion and the second portion are in the open position. The method further includes transitioning the first portion and the second portion from the closed position to the open position. In certain embodiments, the method further includes, when the first portion and the second portion are in the closed position, fastening the fourth side to the second side via one or more portion fasteners disposed on at least one of the second side and the fourth side. In certain embodiments, the one or more portion fasteners are disposed in a staggered arrangement. In certain embodiments, the one or more portion fasteners are magnets. In certain embodiments, each magnet is disposed within a steel channel having a base portion and two legs with two fold-overs, each magnet secured in part by the two fold-overs. In certain embodiments, the method further includes, when the first portion and the second portion are in the open position, fastening the portable carrier to a metal wall via the magnets. In certain embodiments, transitioning the first portion and the second portion from a closed position to an open position is facilitated by a handle disposed on at least one of the first portion, the second portion, and the third portion. In certain embodiments, the handle extends outward from the third portion when pulled and retracts when released such that the handle lies flat against the third portion.

Yet still other embodiments provide for a fastener for a portable carrier. The fastener includes a steel channel, a magnet, and a fabric strip. The steel channel has a base portion and two legs with two fold-overs. The magnet is disposed within the steel channel and secured in part by the two fold-overs. The fabric strip passes between the two legs, over the magnet, and under the two fold-overs. In certain embodiments, the magnet has a width of about 0.62 inches, a length of about 1.0 inches, and a height of about 0.16 inches. In certain embodiments, each leg has a height of about 0.253 inches. In certain embodiments, the two legs carry a magnetic force generated by the magnet.

Yet still other embodiments provide for another fastener for a portable carrier. The fastener includes a steel channel and a magnet. The steel channel has a base portion and two legs. The base portion has two slots operative to secure the fastener to a portable carrier via a fabric strip. The magnet is disposed within the steel channel.

Thus, as will be appreciated, some embodiments of the present invention provide for a portable carrier that is compact, quickly securable/removable to/from a metal wall, and capable of storing tools, equipment, documentation, and/or other objects. Accordingly, some embodiments of the present invention provide for a carrier that allows maintenance personal to organize/group tools specific to a particular task within a single device that can be quickly deployed to and/or moved from one location to another. Moreover, as the magnets and steel carriers disclosed herein provide for fasteners having strong magnetic coupling with a metal wall, some embodiments of the present invention provide for a portable carrier that is capable of securing heavy objects to a metal wall.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A portable carrier for storing one or more objects, the portable carrier comprising:

a first portion having a first side and a second side opposite the first side, the second side having at least one magnet;

a second portion having a third side and a fourth side opposite the third side, the fourth side having at least one magnet, the first and third sides defining an exterior of the carrier and the second and fourth sides defining an interior of the carrier;

a third portion that connects the first portion to the second portion and is adapted to allow the first portion and the second portion to transition between an open position and a closed position;

a handle located on the third portion between the first side of the first portion and the third side of the second portion on the exterior of the carrier;

one or more object fasteners located on at least one of the first side and the third side for fastening the one or more objects to the exterior of the carrier; and wherein in the open position, the interior of the portable carrier can be secured to a surface via the magnets, and one or more objects can be secured to the exterior of the carrier.

2. The portable carrier of claim 1, wherein the magnets are adapted to fasten the fourth side to the second side when the first portion and the second portion are in the closed position.

3. The portable carrier of claim 1, wherein the magnets are disposed in a staggered arrangement.

4. The portable carrier of claim 1, wherein each magnet is contained within a steel channel having a base portion and two legs with two fold-overs, each magnet secured in part by the two fold-overs.

5. The portable carrier of claim 4, wherein a fabric strip passes between the two legs over the magnet and under the two fold-overs.

6. The portable carrier of claim 4, wherein the two fold-overs direct a magnetic force generated by the magnet.

7. The portable carrier of claim 1, wherein each magnet is contained within a steel channel having a base portion with one or more slots, a fabric strip passing through the slots so as to secure the base portion to at least one of the second and the fourth sides of the portable carrier.

8. The portable carrier of claim 1, wherein at least one of the first portion and the second portion include a grommet.

* * * * *